US006115328A

United States Patent [19]

Chan

[11] Patent Number: 6,115,328

[45] Date of Patent: Sep. 5, 2000

[54] TRAVEL ALARM CLOCK WITH AUTOMATIC SLOW MOTION SETUP

[76] Inventor: Sik Leung Chan, Flat F, 2/F, Block 8, Lily Manison, Site 9, Whampoa Garden, Kowloon, The Hong Kong Special Administrative Region of the People's Republic of China

[21] Appl. No.: 09/323,920

[22] Filed: Jun. 2, 1999

[51] Int. Cl.[7] ..... G04B 37/00; G04B 23/00

[52] U.S. Cl. ..... 368/262

[58] Field of Search ..... 368/276, 283, 368/309, 243, 262

[56] References Cited

U.S. PATENT DOCUMENTS

| | | | |
|---|---|---|---|
| 2,996,875 | 8/1961 | Graef . | |
| 4,282,596 | 8/1981 | Siefert et al. | 368/262 |
| 4,449,833 | 5/1984 | Montgomery | 368/262 |

*Primary Examiner*—Vit Miska
*Attorney, Agent, or Firm*—Allen R. Morganstern, Esq.

[57] ABSTRACT

A travel alarm clock which pivots to an open viewable position by preloaded pivot joints and which sets itself up automatically with a slow motion action upon pressing of a button.

13 Claims, 3 Drawing Sheets

TRAVEL ALARM CLOCK WITH AUTOMATIC SLOW MOTION SETUP

FIELD OF THE INVENTION

The present invention relates to travel alarm clocks which set up automatically in a viewing position with a slow motion action.

BACKGROUND OF THE INVENTION

Travel alarm clocks are commodity items which are difficult to differentiate by function or operation. Most "designer" versions use unique style features or decorative details, but the basic function or operation is common. Typically, a travel alarm clock is enclosed in a case for protection during travel. It is then opened and set up by the user at the destination. There is usually a bit of fumbling involved as the heavy body of the clock loosely pivots forward and must be urged into the bottom retaining section.

Moving a set up travel alarm clock often causes the clock to fold down, and then it must be set up again. The loose pivots and hinges used on most travel alarm clocks do not evoke the aura of luxury regardless of the jeweled carefully designed appearance; even when closed, loose fitting parts may jiggle.

OBJECTS OF THE INVENTION

It is therefore an object of the present invention to provide a travel alarm clock with preloaded pivot joints which are tight and precise in operation.

It is another object of the present invention to provide a travel alarm clock which sets itself up automatically with a slow motion action upon pressing of a button.

It is yet another object of the present invention to provide these features using a low cost mechanism.

SUMMARY OF THE INVENTION

In keeping with these objects and others which may become apparent, the present invention includes a travel alarm clock which pivots to an open viewable position by preloaded pivot joints which are tight and precise in operation. The travel alarm clock sets itself up automatically with a slow motion action upon pressing of a button.

When closed, the travel alarm clock includes a top cover over a bottom case. A latch button opens the travel alarm clock when set up for use.

The travel alarm clock also includes conventional control buttons for setting time or alarm and a conventional liquid crystal display on the face of the clock housing. The case is hinged while the clock housing pivots from the case top.

When setting up the clock by opening it for use, the clock is placed on a horizontal surface, and then a release button is pressed inward and released. This causes the top cover to rise as the clock housing swings forward in a slow, smooth motion and latches open at the bottom cover to a stable position.

To close the clock, the clock housing is pushed into the case and then the case top is pushed down until it latches with the bottom case.

One or more spring plungers aid in the initial deployment of clock housing when a latch button is activated. The smooth, slow motion of the opening of the clock occurs by means of one or more torsion coil springs which urge the clock housing to swing outward.

However, the spring action of the torsion coil springs is muted because the coil springs are attached to and located within a cylindrical housing drum, which rotates in a slow motion as it contacts a layer of grease, such as silicone grease, within the housing in which the cylindrical housing drum rotates.

DETAILED DESCRIPTION OF THE PREFERRED EMBODIMENT

Figure 1A:
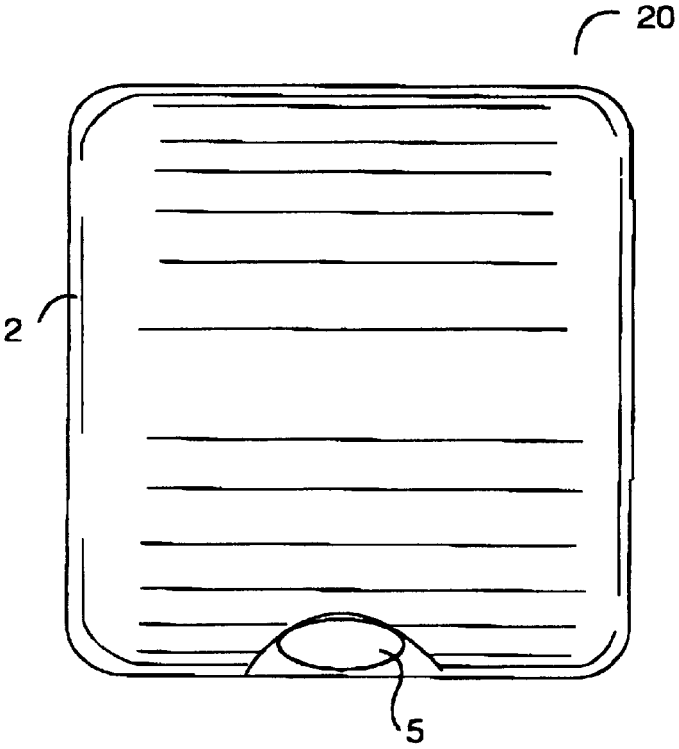
FIG. 1A shows a top elevational view of the travel alarm clock of the present invention when closed.
Figure 1C:
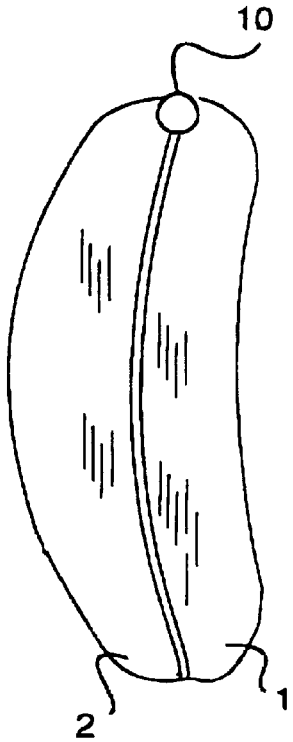
FIG. 1C shows a side elevational view of the travel alarm clock as depicted in FIG. 1A when closed.
Figure 1B:
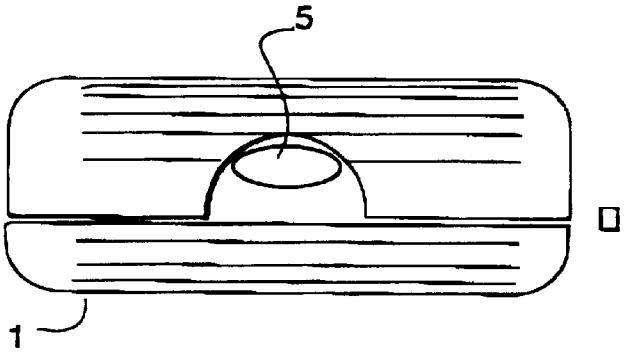
FIG. 1B shows a front elevational view of the travel alarm clock as depicted in FIG. 1A when closed.

FIGS. 1A, 1B and 1C show three views of travel alarm clock 20 of the present invention when closed. Travel alarm clock 20 includes top cover 2, bottom case 1 and latch button 5.

Figure 2A:
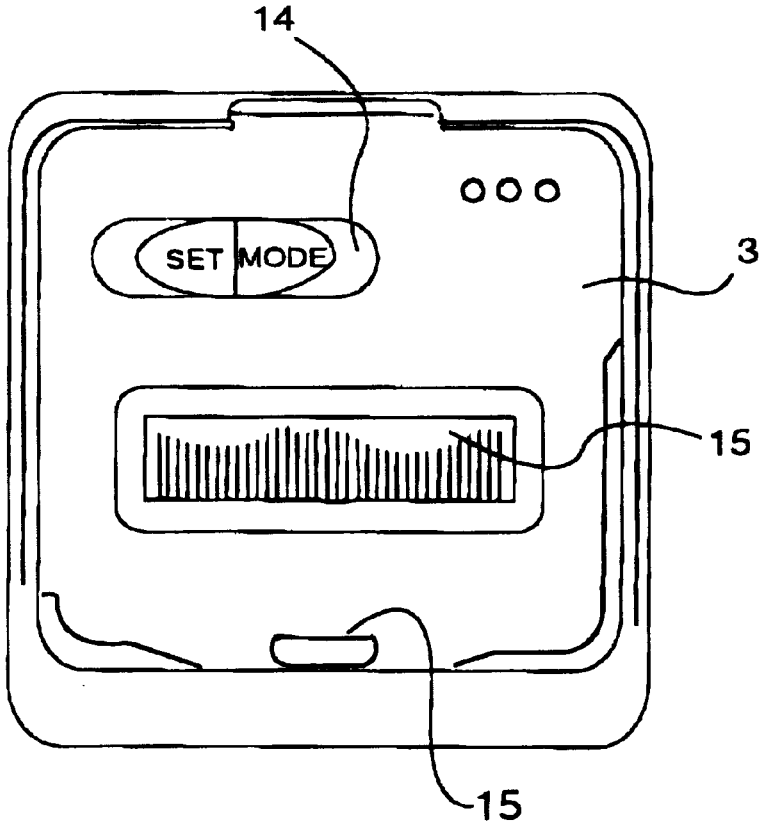
FIG. 2A shows a front elevational view of the travel alarm clock as depicted in FIG. 1B in a set up, open position.
Figure 2B:
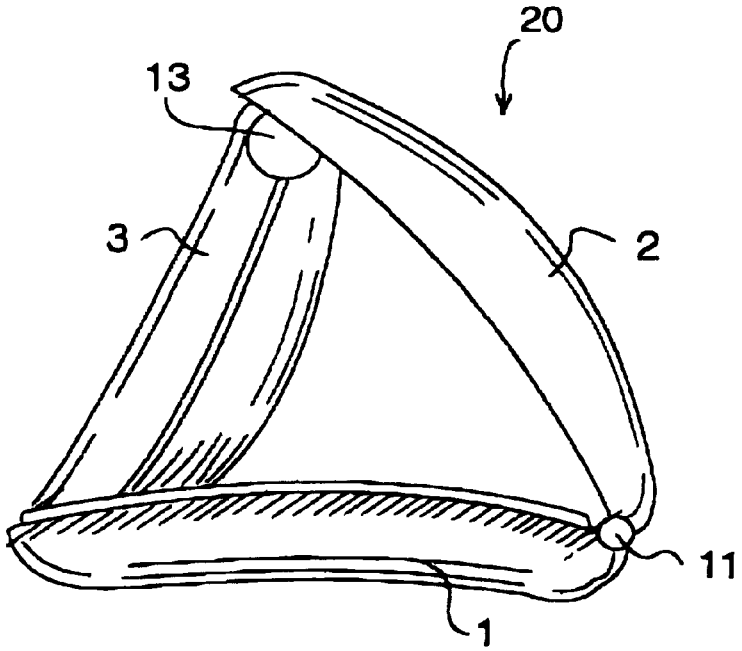
FIG. 2B. shows a side elevational view of the travel alarm clock as depicted in FIG. 2A in a set up open position; and, FIG. 3 is a perspective exploded view of the components of the travel alarm clock as depicted in FIGS. 1 and 2.

FIGS. 2A and 2B show front and side views of travel alarm clock 20 when set up for use. Control buttons 14 and a liquid crystal display 15 are shown on the face of clock housing 3. The case is hinged at pivot 10, while the clock housing pivots from at least one bracket, the embodiment, however, being depicted in the drawings evidencing a pair of brackets 13, which are part of case top cover 2. The operation of the controls for setting time or alarm are conventional.

To set up (or open) clock 20 for use, clock 20 is placed on a horizontal surface, and then with a finger or two to steady case top cover 2, release button 5 is pressed inward and released. Then, case top cover 2 rises while clock housing 3 swings forward in a slow smooth motion and latches open at the front of bottom case 1. This occurs silently and automatically.

The open position of clock 20 is stable, so clock 20 can be moved easily with no chance of closing inadvertently. To close clock 20, clock housing 3 is simply pushed in and then case top cover 2 is pushed down until it latches with bottom case 1.

Figure 3:
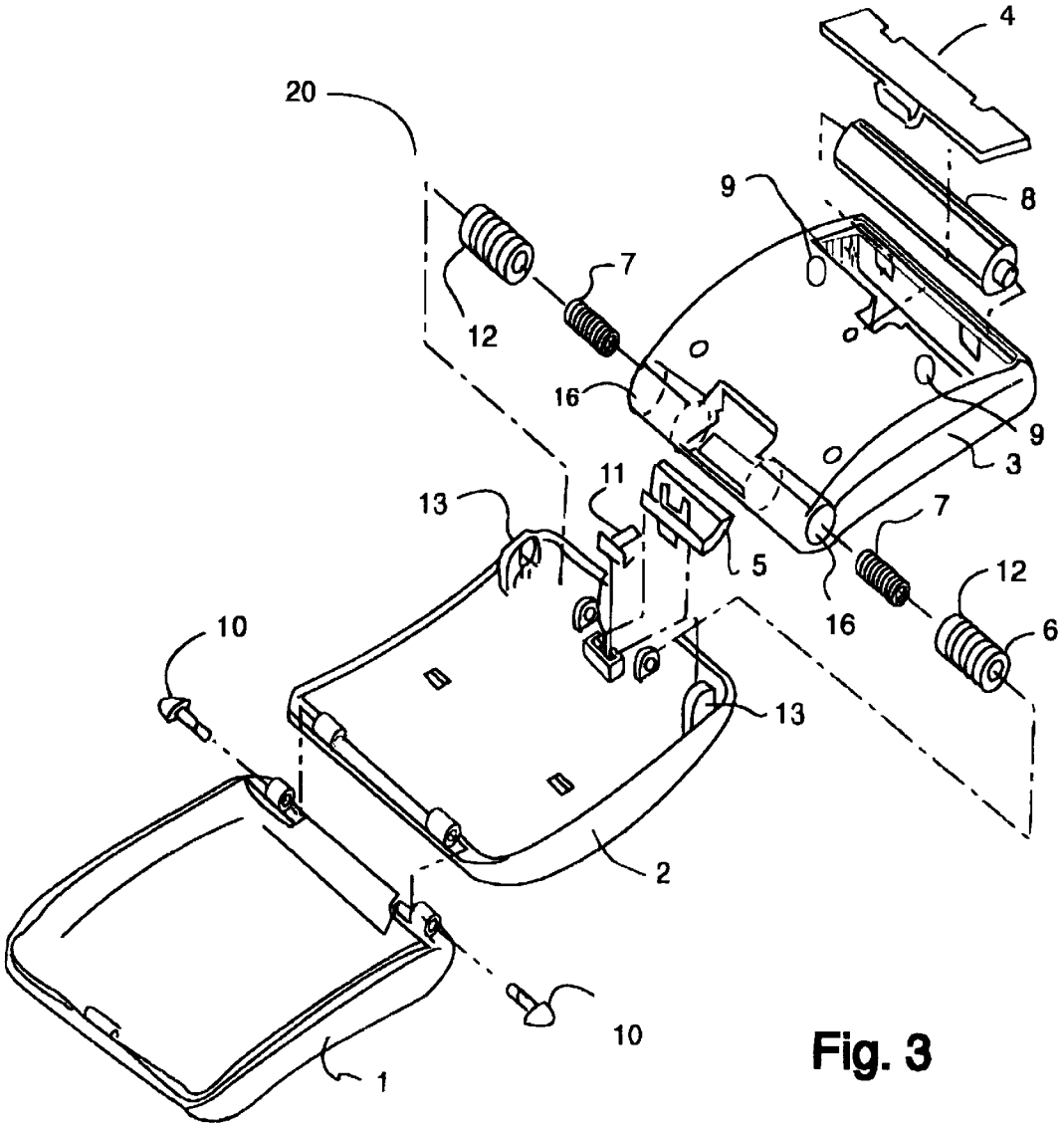

FIG. 3 is an exploded view of clock 20. Leaf spring 11 properly biases latch button 5. Battery compartment cover 4 provides access to battery 8. Preferably, one or more spring plungers 9, such as a pair, insure that clock 20 is tight and secure within its case when closed. Spring plungers 9 also aid in the initial deployment of clock housing 3 when latch button 5 is pushed in and activated.

The automatic smooth, slow motion set up of clock 20 from a closed position to an open viewable position is powered by at least one spring means, such as two torsion coil springs 7, which are torqued during assembly to tend to swing clock housing 3 outward. The inner ends of torsion coil springs 7 engage molded nibs (not shown) inside at least one bearing recess within clock housing 3, such as a pair of bearing holes 16 at the sides near the top of clock housing 3. The outer ends of torsion coil springs 7 engage similar nibs (not shown) inside the closed outer ends of at least one bearing, such as a pair of bearing cylinder drums 6. These bearing cylinder drums 6 are captured and restrained from turning by brackets 13 which are part of top cover 2. A layer of thick grease 12, such as silicone grease, fills the space between cylindrical cavities 16 formed in clock housing 3 and bearing cylinder drums 6. The purpose of grease 12 is to provide a fluid shear counter-torque which is speed dependent. It is the key ingredient which transforms an otherwise quick, jerky movement of torsion coil springs 7 into the fairly constant smooth slow motion of clock 20.

The action of manually closing clock 20 stores energy in torsion coil springs 7, which is then used in the opening or setting-up automatic action.

Latch member 14 at the front of bottom case 1 engages recess 15, as shown in FIG. 2, during set up. The forward bias force of clock housing 3 keeps these two elements engaged even if the clock is lifted.

It is further noted that other modifications may be made to the present invention without departing from the scope of the invention, as noted in the appended Claims.

I claim:

1. A travel alarm clock having a viewable clock face, a time display and time and alarm setting control buttons, said travel alarm clock having a power source including a battery compartment having at least one battery therein, said travel alarm clock openable to a position of viewing automatically with a smooth slow motion from a closed position to an open position, said travel alarm clock comprising:

a top cover pivotable at a proximal end about a bottom case at one edge of said bottom case, said bottom case being pivotable about a clock housing at an opposite edge of said bottom case, said clock housing being pivotable at a proximal edge to an open viewable position where a distal end of said clock housing engages a distal end of said top cover, to form a triangular configuration when viewed in cross section;

said travel alarm clock having a spring means urging said clock housing from engagement with said distal end of said top cover upon release of a latch; and, said travel alarm clock further having a dampening means resisting urging of said spring means against said clock housing.

2. The travel alarm clock as in claim 1 wherein said latch comprises a finger operable release button connecting said clock housing with said cover.

3. The travel alarm clock as in claim 1 wherein in a closing position, said clock housing is pushed in under said top cover until said top cover latches with said bottom case.

4. The travel alarm clock as in claim 2 wherein said latch is engageable with a leaf spring biasing said finger operable release latch button.

5. The travel alarm clock as in claim 2 further comprising at least one spring plunger urging against said clock housing, said spring plunger urging said clock housing up away from said bottom case upon deployment of said clock housing to an open viewable position when said latch button is activated.

6. The travel alarm clock as in claim 5 wherein said at least one spring plunger comprises a pair of spring plungers.

7. The travel alarm clock as in claim 1 wherein said spring means urging said clock housing from engagement with said distal end of said top cover upon release of a latch is at least one torsion coil spring, said at least one torsion coil spring being torqued to swing said clock housing outward upon release of said latch button.

8. The travel alarm clock as in claim 7 wherein an inner end of said at least one torsion coil spring engages at least one nib inside at least one bearing hole within said clock housing and wherein further an outer end of said at least one torsion coil spring engages a further nib inside at least one bearing cylinder drum, said at least one bearing cylinder drum being captured and restrained from turning by at least one bracket of said top cover of said travel alarm clock.

9. The travel alarm clock as in claim 8 wherein said at least one torsion coil spring comprises a pair of pair of torsion coil springs within a pair of corresponding bearing cylinder drums, each said bearing cylinder drum rotating within corresponding bearing holes at a respective side of said clock housing near a top portion of said clock housing.

10. The travel alarm clock as in claim 1 wherein said dampening means comprises a layer of grease filling a space between said at least one bearing hole and said at least one bearing cylinder drum, said grease providing a fluid shear counter-torque force which is speed dependent, said fluid shear counter-torque force transforming a quick jerky movement of said at least one torsion coil spring into a constant smooth slow motion of said travel alarm clock.

11. The travel alarm clock as in claim 7 wherein closing of said travel alarm clock stores energy in said at least one torsion coil spring.

12. The travel alarm clock as in claim 2 wherein said latch member is fixed in position within said bottom case during a viewing position of use of said travel alarm clock by means of a forward bias force of said clock housing against said distal edge of said cover.

13. The travel alarm clock as in claim 9 wherein said at least one bearing cylinder drum is captured and restrained from turning by at least one bracket of said top cover.

* * * * *